US010165810B2

(12) United States Patent
Takata

(10) Patent No.: US 10,165,810 B2
(45) Date of Patent: Jan. 1, 2019

(54) CUT RESISTANT GLOVE, AND MANUFACTURING METHOD OF CUT RESISTANT GLOVE

(71) Applicant: SHOWA GLOVE CO., Hyogo (JP)

(72) Inventor: Teruyoshi Takata, Hyogo (JP)

(73) Assignee: Showa Glove Co., Hyogo (JP)

( * ) Notice: Subject to any disclaimer, the term of this patent is extended or adjusted under 35 U.S.C. 154(b) by 247 days.

(21) Appl. No.: 14/848,940

(22) Filed: Sep. 9, 2015

(65) Prior Publication Data

US 2016/0073713 A1 Mar. 17, 2016

(30) Foreign Application Priority Data

Sep. 12, 2014 (JP) ..... 2014-187072

(51) Int. Cl.
*A41D 19/00* (2006.01)
*A41D 19/015* (2006.01)
(Continued)

(52) U.S. Cl.
CPC ..... *A41D 19/01505* (2013.01); *D02G 3/12* (2013.01); *D02G 3/442* (2013.01);
(Continued)

(58) Field of Classification Search
CPC ..... A41D 19/0024; A41D 19/0058; A41D 19/015; A41D 19/01505; A41D 19/01558; A41D 2500/10; D04B 1/28
(Continued)

(56) References Cited

U.S. PATENT DOCUMENTS 4,793,130 A * 12/1988 Togashi ..... D02G 3/12 57/210
6,161,400 A * 12/2000 Hummel ..... A41D 19/01505 2/16
(Continued)

FOREIGN PATENT DOCUMENTS

CN 1886539 A 12/2006
CN 102292481 A 12/2011
(Continued)

OTHER PUBLICATIONS

Office Action dated Aug. 15, 2018 of corresponding European Patent Application No. 15184886.8.

*Primary Examiner* — Timothy K Trieu
(74) *Attorney, Agent, or Firm* — Norris McLaughlin & Marcus P.A.

(57) ABSTRACT

Provided is a cut resistant glove having stretchability and being superior in the texture and fit while a string made of a metal or glass fiber is prevented from sticking out, irrespective of the gauge number. A cut resistant glove having a glove main body manufactured by plating knitting using a ground yarn and an additional yarn, in which the ground yarn includes a core material, and a cover yarn wound around the core material, the core material having a string made of a metal or glass fiber, and the additional yarn being made of an organic fiber, and in which the ratio of the average thickness of the additional yarn to the average thickness of the ground yarn is no less than 0.9 and no greater than 2.5. The core material preferably further has a support yarn made of an organic fiber arranged along the string.

8 Claims, 3 Drawing Sheets

(51) Int. Cl.

| | |
|---|---|
| ***D02G 3/12*** | (2006.01) |
| ***D02G 3/44*** | (2006.01) |
| ***D04B 1/28*** | (2006.01) |

(52) U.S. Cl.
CPC ..... *D04B 1/28* (2013.01); *A41D 2500/10* (2013.01); *A41D 2500/54* (2013.01); *D10B 2403/0112* (2013.01); *D10B 2403/0114* (2013.01)

(58) Field of Classification Search
USPC ..... 2/167, 168
See application file for complete search history.

(56) References Cited

U.S. PATENT DOCUMENTS

| | | | | |
|---|---|---|---|---|
| 7,007,308 | B1 * | 3/2006 | Howland ..... | A41D 19/01505 2/16 |
| 7,762,053 | B2 | 7/2010 | Takada | |
| 8,789,394 | B2 * | 7/2014 | Tatsumi ..... | D02G 3/322 2/167 |
| 2005/0086924 | A1 | 4/2005 | Kolmes | |
| 2008/0289312 | A1 | 11/2008 | Takada | |
| 2010/0186144 | A1 | 7/2010 | Zhu | |
| 2010/0186456 | A1 | 7/2010 | Zhu | |
| 2012/0233740 | A1 | 9/2012 | Veillet | |
| 2014/0005616 | A1 | 1/2014 | Moreland et al. | |
| 2014/0090349 | A1 * | 4/2014 | Fisher ..... | D02G 3/367 57/222 |

FOREIGN PATENT DOCUMENTS

| | | | |
|---|---|---|---|
| CN | 102292483 | A | 12/2011 |
| CN | 102657395 | A | 9/2012 |
| EP | 1 780 318 | | 5/2006 |
| EP | 2468122 | | 6/2012 |
| JP | 4897684 | | 3/2012 |
| JP | 5349797 | | 11/2013 |
| WO | WO-2007/015439 | | 2/2007 |
| WO | WO-2007/015333 | | 3/2012 |

* cited by examiner

CUT RESISTANT GLOVE, AND MANUFACTURING METHOD OF CUT RESISTANT GLOVE

TECHNICAL FIELD

The present invention relates to a cut resistant glove, and a method for manufacturing a cut resistant glove.

BACKGROUND OF THE INVENTION

As cut resistant gloves for use in operations in which a sharp edged tool is used, operations in which glass, metal plate, etc., with a sharp edge is used, and the like, cut resistant gloves knitted using a ground yarn having a string made of a metal or glass fiber as a core material have been known.

In the ground yarn used in such conventional cut resistant gloves proposed, for the purpose of preventing the glove from deterioration of the texture due to the string that sticks out from the surface of the ground yarn, the string and a support yarn made of an organic fiber provided along the string are used as a core material, and a cover yarn is wound around the core material (see Japanese Patent Nos. 4897684 and 5349797). According to the conventional cut resistant glove, sticking out of the string due to cutting is prevented by way of the support yarn, whereas deterioration of the texture is prevented by the cover yarn. Moreover, in the conventional cut resistant glove, an additional yarn having a favorable texture is used to carry out plating knitting such that the additional yarn is arranged to be situated on the inner surface of the glove, thereby improving the texture and/or fit.

However, yarns including a large number of filaments and having a great fineness are used as the support yarn and the cover yarn in this conventional ground yarn in order to prevent the sticking out of the string due to cutting, as well as the deterioration of the texture; therefore, the ground yarn has a great thickness. For example, in a case where such a ground yarn and an additional yarn are used to knit a glove of at least 13 gauges, due to a limitation of the thickness of the yarn which can be used in a high-gauge knitting machine, as generally referred to, of at least 13 gauges; therefore, it is inevitable to make the setting of the thickness of the additional yarn smaller, as compared with the thickness of the ground yarn. Thus, the effect of the additional yarn by the plating knitting becomes inferior, and for example, the ground yarn is likely to be exposed from the gap of the additional yarns, whereby it may be difficult to ensure the texture and/or the fit of the glove. In addition, due to having a structure in which the cover yarn squeezes the core material, the conventional ground yarn becomes less flexible, thereby being more likely to give hard feel on touch. Accordingly, even in the case of gloves composed of smaller stitches of at least 13 gauges for which higher flexibility is expected, as compared with gloves composed of larger stitches of less than 13 gauges (for example, 10 gauges), the flexibility may be insufficient when the conventional ground yarn is used.

PRIOR ART DOCUMENTS

Patent Document 1: Japanese Patent No. 4897684
Patent Document 2: Japanese Patent No. 5349797

SUMMARY OF THE INVENTION

The present invention was made in view of these circumstances, and an object of the invention is to provide a cut resistant glove having stretchability and being superior in the texture and fit while a string made of a metal or glass fiber is prevented from sticking out, irrespective of the gauge number.

According to an aspect of the invention made for solving the aforementioned problems, a cut resistant glove having a glove main body is manufactured by plating knitting using a ground yarn and an additional yarn, in which the ground yarn includes a core material, and a cover yarn wound around the core material, the core material having a string made of a metal or glass fiber, and the additional yarn being made of an organic fiber, and in which the ratio of the average thickness of the additional yarn to the average thickness of the ground yarn is no less than 0.9 and no greater than 2.5.

Owing to the ratio of the average thickness of the additional yarn to the average thickness of the ground yarn falling within the above range, the additional yarn in the cut resistant glove prevents the ground yarn from being brought into contact with the hand through exposure out from the stitches. In addition, according to the cut resistant glove, the texture and/or the fit of the glove can be readily secured by providing a thinner cover yarn of the ground yarn, in a case where the cut resistant glove composed of smaller stitches of at least 13 gauges is to be knitted. Moreover, owing to the ratio of the average thickness of the additional yarn to the average thickness of the ground yarn falling within the above range, influences from the ground yarn on the glove can be reduced, whereby necessary flexibility for the cut resistant glove composed of smaller stitches of at least 13 gauges is likely to be secured. Thus, the cut resistant glove is superior in texture irrespective of the gauge number.

It is preferred that the core material further has a support yarn made of an organic fiber arranged along the string. When the core material thus further has the support yarn made of an organic fiber arranged along the string, an effect of preventing the string from cutting is enhanced. Moreover, the support yarn and the additional yarn can prevent the ground yarn from being brought into contact with the hand through exposure out from the stitches. Furthermore, in a case where the cut resistant glove composed of smaller stitches of at least 13 gauges is to be knitted, the texture and/or the fit of the glove can be readily secured by providing a thinner support yarn and/or cover yarn of the ground yarn.

Additionally, owing to the ratio of the average thickness of the additional yarn to the average thickness of the ground yarn falling within the above range, influences from the core material of the ground yarn on the glove is further reduced, whereby necessary texture for the cut resistant glove composed of smaller stitches of at least 13 gauges is more likely to be secured.

The additional yarn preferably includes a core yarn, and a cover yarn wound around the core yarn. When the additional yarn is thus composed of a core yarn, and a cover yarn wound around the core yarn, the texture of the glove is further improved while necessary stretchability of the additional yarn is secured.

The average thickness of the core yarn of the additional yarn is preferably no less than 10 dtex and no greater than 44 dtex. When the average thickness of the core yarn of the additional yarn thus falls within the above range, the fit of the glove is further improved, and the exposure of the ground yarn as well as the sticking out of the string resulting from contraction of the additional yarn can be more certainly prevented.

The core yarn of the additional yarn is preferably a polyurethane elastic yarn, and the cover yarn of the additional yarn is preferably a nylon yarn. When the core yarn of the additional yarn is thus a polyurethane elastic yarn, the fit of the glove is improved, and contraction of the ground yarn is suitably prevented, whereby the effect of preventing the ground yarn from being brought into contact with the hand through exposure out from the stitches can be enhanced. In addition, when the cover yarn of the additional yarn is a nylon yarn, the flexibility of the glove can be increased.

The metal is preferably a stainless steel. When the metal is thus a stainless steel, the cut resistance can be improved.

The ground yarn is preferably arranged on an outer surface side of the glove. When the glove is knitted such that the ground yarn is thus arranged on the outer surface side of the glove, the additional yarn can easily and certainly prevent the ground yarn from being brought into contact with the hand through exposure out from the stitches.

It is preferred that a coating layer made of a resin or rubber is provided on an outer surface of the glove main body. By thus providing a coating layer made of a resin or rubber on the outer surface of the glove main body, an anti-slipping effect can be imparted.

According to another aspect of the present invention made for solving the aforementioned problems, a method for manufacturing a cut resistant glove using a knitting machine includes the step of plating knitting using a ground yarn and an additional yarn, in which the ground yarn includes a core material, and a cover yarn wound around the core material, the core material having a string made of a metal or glass fiber, and the additional yarn being made of an organic fiber, and in which the ratio of the average thickness of the additional yarn to the average thickness of the ground yarn is no less than 0.9 and no greater than 2.5.

In the method for manufacturing a cut resistant glove of the another aspect of the present invention, since the plating knitting is conducted, and the ratio of the average thickness of the additional yarn to the average thickness of the ground yarn falls within the above range, the additional yarn prevents the ground yarn from being brought into contact with the hand through exposure out from the stitches; therefore, the cut resistant glove that is superior in the texture and/or the fit of the glove can be manufactured. In addition, since the ratio of the average thickness of the additional yarn to the average thickness of the ground yarn falls within the above range, the flexibility of the cut resistant glove is likely to be ensured, and the cut resistant glove that is superior in the texture can be manufactured irrespective of the gauge number.

When the thickness of the yarn is publicly known as in the case of commercially available yarns, the term "thickness of a yarn" as referred to herein means the known thickness of the yarn, whereas when the thickness of the yarn is not publicly known, the term "thickness of a yarn" means the weight (g) of the yarn of the length of 10,000 m when the yarn is linearly stretched with a force of 0.3 N. For example, when the weight of 10,000 m of a yarn is 100 g, the yarn is referred to as having a thickness of 100 dtex. It is to be noted that unless otherwise designated particularly, when the yarn is formed by stranding a plurality of single yarns, the term "thickness of a yarn" as referred to means the total thickness of the plurality of single yarns composing the yarn.

EFFECTS OF THE INVENTION

As explained in the foregoing, the cut resistant glove of the present invention has stretchability, and is superior in the texture and fit, while a string made of a metal or glass fiber is prevented from sticking out irrespective of the gauge number.

DESCRIPTION OF THE PREFERRED EMBODIMENTS

Hereinafter, embodiments of the present invention will be explained in detail with reference to the drawings.

Figure 1:
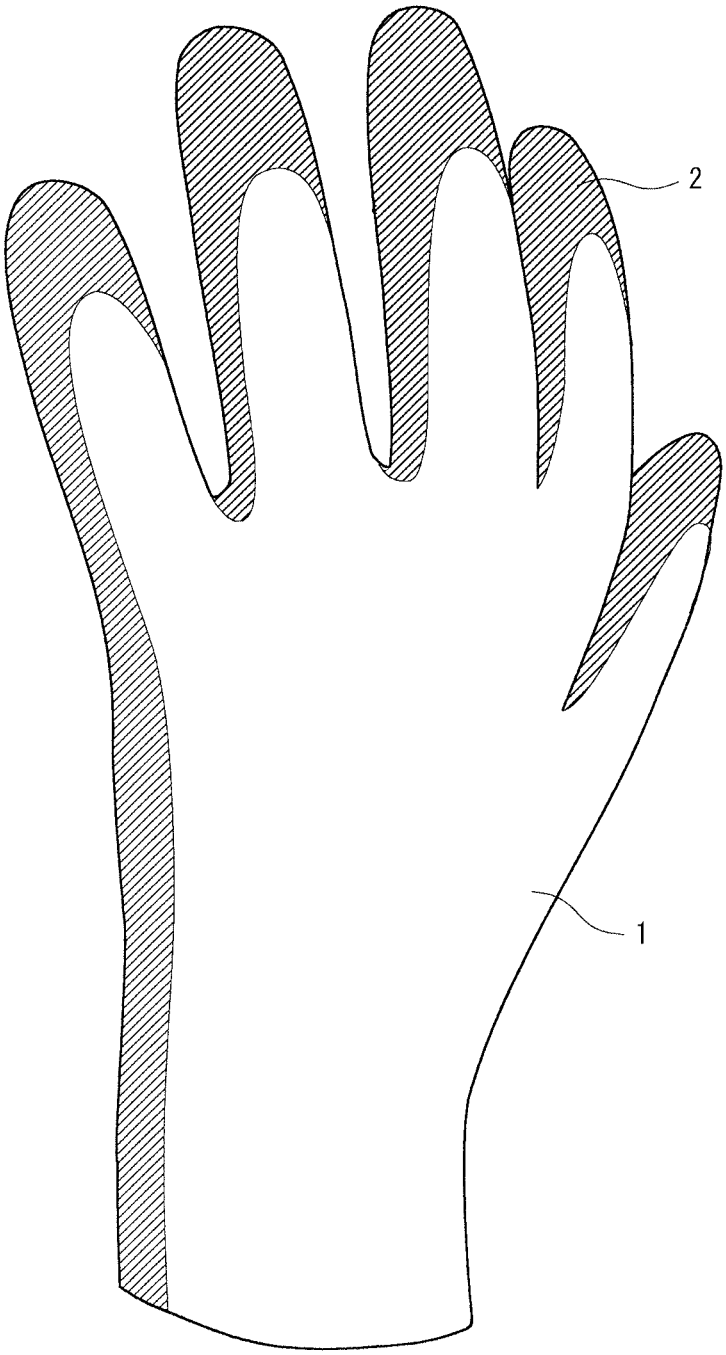
FIG. 1 shows a schematic view of a cut resistant glove according to an embodiment of the present invention viewed from the side of the back.
Figure 2:
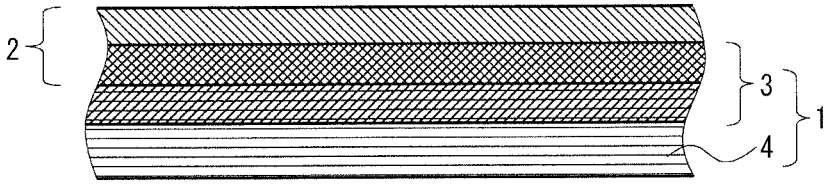
FIG. 2 shows a partial cross sectional view of the cut resistant glove shown in FIG. 1.

The cut resistant glove shown in FIG. 1 and FIG. 2 includes a glove main body 1 made of fibers, and a coating layer 2 made of a resin or rubber provided on a palm (including fingers) region and side region thereof, and fingertip regions on the outer surface of the glove main body 1.

Glove Main Body

The glove main body 1 is manufactured by plating knitting using, as shown in FIG. 2, a ground yarn 3 and an additional yarn 4 such that the ground yarn 3 is arranged on the outer surface side of the glove main body 1. In addition, the coating layer 2 is impregnated predominantly in the ground yarn 3. In these regards, the ground yarn 3 and the additional yarn 4 are explained with reference to FIG. 3 and FIG. 4.

Ground Yarn

Figure 3:
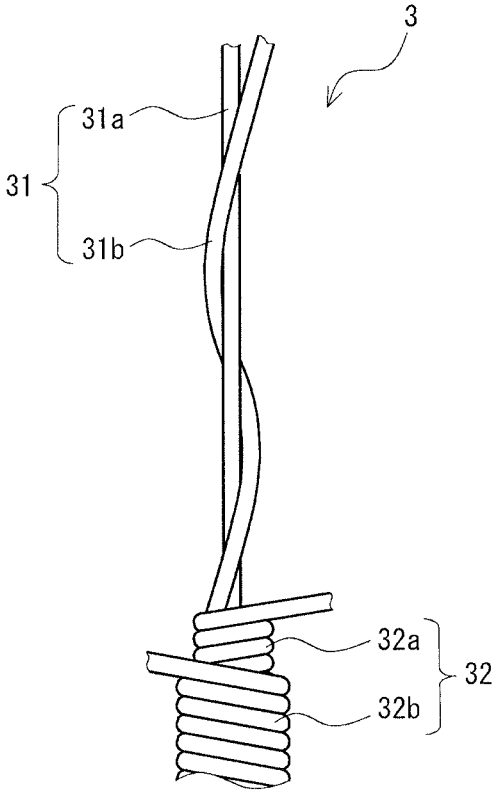
FIG. 3 shows a schematic view illustrating a structure of a ground yarn used in the cut resistant glove of the present invention.
Figure 4:
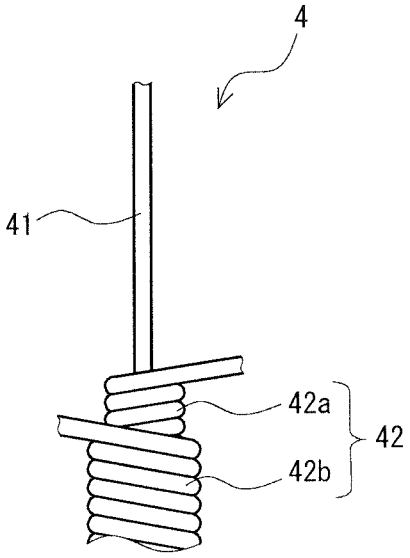
FIG. 4 shows a schematic view illustrating a structure of an additional yarn used in the cut resistant glove of the present invention.

The ground yarn 3 shown in FIG. 3 includes a core material 31, and a cover yarn 32 wound around the core material 31. In addition, the core material 31 includes a string 31*a* made of a metal or glass fiber, and a support yarn made of an organic fiber 31*b* arranged along the string 31*a*.

The metal which may be used for the string 31*a* is preferably a metal having superior strength and a high modulus of elasticity, and examples of the metal include a stainless steel, titanium, aluminum, silver, bronze, and the like. Of these, a stainless steel is more preferred. The stainless steel has superior strength and is chemically stable and less likely to generate rust; therefore, the cut resistance can be improved. In addition, the stainless steel is accompanied by a low material cost. Among the stainless steels, SUS304 is particularly preferred since it is soft and has superior bending strength. Moreover, when a glass fiber that is a highly strong fiber is used as the string 31*a*, a plurality of glass fibers may be used as a bundle. It is to be noted that in light of ease in breaking, irritation to the hand skin, dusting characteristics in use, and the like, the string 31*a* is preferably made of a metal.

Furthermore, when the string 31*a* is a metal, not a string formed by stranding fine wires but an unprocessed element wire may be used as the string 31*a*. Since the string formed by stranding fine wires tends to be significantly resilient, the texture of the cut resistant glove may be deteriorated when such a string is used.

When the string 31*a* is made of a metal, the lower limit of the average diameter of the string 31*a* is preferably 20 μm, and more preferably 25 μm. In addition, the upper limit of the average diameter of the string 31*a* is preferably 50 μm, and more preferably 35 μm. When the average diameter of the string 31*a* is less than the lower limit described above, the strength of the string 31*a* may be insufficient and sticking out of the string 31*a* due to cutting may occur. On the other hand, when the average diameter of the string 31*a* is greater than the upper limit described above, knitting processability of the ground yarn 3, and workability in use of the glove may be deteriorated. The term "string diameter" as referred to herein means a diameter of a perfect circle having an area equal to the cross sectional area of the string, and the term "average diameter of a string" as referred to herein means an average of string diameters.

When the string 31*a* is made of a glass fiber, although not particularly limited as long as the average thickness falls within an, intended range in the present invention, a glass fiber bundle having an average thickness of no less than 10 dtex and less than 87 dtex may be used. When the average thickness of the string 31*a* is less than the lower limit described above, the strength of the string 31*a* may be insufficient and sticking out of the string 31*a* due to cutting may occur. On the other hand, when the average thickness of the string 31*a* is greater than the upper limit described above, the knitting processability of the ground yarn 3, and the workability in use of the glove may be deteriorated.

The lower limit of the number of the string 31*a* is preferably one. In addition, the upper limit of the number of the string 31*a* is preferably two, and more preferably one. When the number of the string 31*a* is greater than the upper limit described above, the cut resistant glove may be so hard that the workability in use of the glove may be deteriorated. It is to be noted that when the string 31*a* is a bundle of glass fibers, the number of the string 31*a* means the number of the bundle of the glass fibers. It is to be noted that a string made of a metal and a string made of glass may be also used in combination.

Since the string 31*a* made of a metal or glass fiber scarcely has stretchability, the string 31*a* is likely to be cut when a tension is applied. Sticking out of the cut string 31*a* from the surface of the ground yarn 3 to the external side may irritate the hand skin of the glove wearer, and may bring about sense of discomfort. The support yarn 31*b* is arranged for the purpose of dispersing the tension applied to the string 31*a*, whereby the cutting of the string 31*a* can be prevented.

The support yarn 31*b* preferably has low stretchability. In the case where the support yarn 31*b* has extendibility, the string 31*a* is likely to be cut upon application of the tension to the ground yarn 3, due to failure to withstand the tension before dispersion of the tension by the support yarn 31*b*. Thus, the cut string 31*a* sticks out from the surface of the ground yarn 3 to the external side, and may bring about sense of discomfort to the glove wearer. On the other hand, in the case where the support yarn 31*b* has contractility, when the ground yarn 3 contracts due to the contractility, the string 31*a* scarcely having stretchability is likely to bend. Thus, the bended string 31*a* sticks out from the surface of the ground yarn 3 to the external side, and may bring about sense of discomfort to the glove wearer. Examples of the yarn having such low stretchability include filament yarns not subjected to crimping processing, etc., (i.e., unprocessed filament yarns).

The organic fiber constituting the support yarn 31*b* preferably has in addition to low physical stretchability as described above, low chemical stretchability resulting from heat and/or agents. Specific examples of the organic fiber include polyethylene, reinforced polyethylene, polyesters, polyparaphenylene terephthalamide, liquid crystal polymers, high-strength polyarylate, and the like. Among these, reinforced polyethylene, polyesters, polyparaphenylene terephthalamide having very high physical stability and superior chemical stability are more preferred.

The lower limit of the average thickness of the support yarn 31*b* is preferably 45 dtex, and more preferably 60 dtex. Whereas, the upper limit of the average thickness of the support yarn 31*b* is preferably 100 dtex, and more preferably 80 dtex. When the average thickness of the support yarn 31*b* is less than the lower limit described above, the effect of preventing the string 31*a* from cutting may be insufficient. On the other hand, when the average thickness of the support yarn 31*b* is greater than the upper limit described above, the ground yarn 3 becomes so thick that the texture of the cut resistant glove composed of stitches of at least 13 gauges, in particular, may be deteriorated.

In the case where the filament yarn is used as the support yarn 31*b*, the lower limit of the number of the filament of the support yarn 31*b* is preferably 12, and more preferably 15. Whereas, the upper limit of the number of the filament of the support yarn 31*b* is preferably 48, and more preferably 36. When the number of the filament of the support yarn 31*b* is less than the lower limit described above, the effect of enwrapping the string 31*a* may be insufficient, whereby the string 31*a* may be likely to stick out from the surface of the ground yarn 3 to the external side. In addition, when the thickness of the support yarn 31*b* is maintained to fall within a certain range, and the number of the filament is decreased, the thickness of one filament tends to be relatively increased. When the thickness of one filament relatively increases in this manner, the texture of the glove may be deteriorated. On the other hand, when the number of the filament of the support yarn 31*b* is greater than the upper limit described above, the thickness of one filament tends to be relatively decreased, whereby the effect of enwrapping the string 31*a* is enhanced; however, the cost for the support yarn 31*b* may be increased. In addition, due to the decreased thickness of one filament of the support yarn 31*b*, the cutting may be likely to occur.

The support yarn 31*b* is arranged around the string 31*a*. When the support yarn 31*b* is thus arranged around the string 31*a*, the effect of preventing the string 31*a* from sticking out is improved.

The support yarn 31*b* may be arranged in parallel with the string 31*a*, or may be wound around the string 31*a*. In this embodiment, an explanation is made with reference to an example in which the support yarn 31*b* is wound around the string 31*a*. The lower limit of the number of winding per meter of the support yarn 31*b* is preferably 2 times, more preferably 15 times, and still more preferably 25 times. In addition, the number of winding per meter of the support yarn 31*b* is preferably less than 60 times, more preferably less than 50 times, and still more preferably less than 45 times. When the number of winding per meter of the support yarn 31*b* is less than the lower limit described above, the effect of preventing the string 31*a* from sticking out may not be sufficiently exhibited. On the other hand, when the number of winding per meter of the support yarn 31*b* is no less than the upper limit described above, since the support yarn 31*b* having a large number of winding has extendibility when a tension is applied to the ground yarn 3, sufficiently dispersing the tension applied to the string 31*a* may fail, whereby the effect of preventing the string 31*a* from cutting may be insufficient.

The cover yarn 32 of the ground yarn 3 is composed of a first cover yarn 32*a*, and a second cover yarn 32*b* wound on the surface of the first cover yarn 32*a*. The second cover yarn 32*b* is wound in a direction opposite to a direction of winding of the first cover yarn 32*a*. When the second cover yarn 32*b* is thus wound in a direction opposite to a direction of winding of the first cover yarn 32*a*, the effect of preventing the string 31*a* from sticking out is enhanced.

The fiber constituting the cover yarn 32 of the ground yarn 3 (first cover yarn 32*a* and second cover yarn 32*b*) is preferably superior in the knitting processability, texture, hygroscopicity and the like, and is exemplified by woolly polyesters, woolly nylon, cotton yarns, polyester spun yarns, and the like. Also, in light of the texture, the cover yarn 32 of the ground yarn 3 is preferably a crimping-processed filament yarn.

The lower limit of the average thickness of the cover yarn 32 of the ground yarn 3 (average thickness of one cover yarn) is preferably 45 dtex, and more preferably 60 dtex. Whereas, the upper limit of the average thickness of the cover yarn 32 of the ground yarn 3 is preferably 100 dtex, and more preferably 85 dtex. When the average thickness of the cover yarn 32 of the ground yarn 3 is less than the lower limit described above, the effect of preventing the string 31*a* from sticking out may be insufficient. On the other hand, when the average thickness of the cover yarn 32 of the ground yarn 3 is greater than the upper limit described above, the ground yarn 3 becomes so thick that the texture of the cut resistant glove composed of stitches of at least 13 gauges, in particular, may be deteriorated.

In the case where the filament yarn is used as the cover yarn 32 of the ground yarn 3, the lower limit of the number of the filament of the cover yarn 32 of the ground yarn 3 (the number of the filament of one cover yarn) is preferably 12, and more preferably 15. Whereas, the upper limit of the number of the filament of the cover yarn 32 of the ground yarn 3 is preferably 48, and more preferably 40. When the number of the filament of the cover yarn 32 of the ground yarn 3 is less than the lower limit described above, the thickness of one filament relatively increases, whereby the cover yarn 32 becomes so hard that the flexibility of the glove as well as feel on touch may be deteriorated. In addition, since the effect of enwrapping the string 31*a* is impaired, the effect of preventing the string 31*a* from sticking out may be insufficient. On the other hand, when the number of the filament of the cover yarn 32 of the ground yarn 3 is greater than the upper limit described above, the thickness of one filament is relatively decreased, whereby the cover yarn 32 is likely to be fluffy, and the appearance and/or feel on touch of the glove may be deteriorated. In the case of the cut resistant glove composed of stitches of at least 13 gauges, in particular, when the number of the filament departs from the above range, the texture may be markedly deteriorated.

The lower limit of the number of winding per meter of the cover yarn 32 of the ground yarn 3 (each number of winding of the first cover yarn 32*a* and the second cover yarn 32*b*) is preferably 400 times, and more preferably 600 times. Whereas, the upper limit of the number of winding per meter of the cover yarn 32 of the ground yarn 3 is preferably 900 times, and more preferably 800 times. When the number of winding per meter of the cover yarn 32 of the ground yarn 3 is less than the lower limit described above, the string 31*a* may stick out from a gap of the ground yarn 3 in producing the ground yarn 3, and/or in the knitting processing of the cut resistant glove. On the other hand, when the number of winding per meter of the cover yarn 32 of the ground yarn 3 is greater than the upper limit described above, twisting of the ground yarn 3 is likely to occur, and defects may be likely to occur in knitting processing of the cut resistant glove.

The lower limit of the average thickness of the ground yarn 3 is preferably 135 dtex, and more preferably 150 dtex. Whereas, the upper limit of the average thickness of the ground yarn 3 is preferably 440 dtex, and more preferably 360 dtex. When the average thickness of the ground yarn 3 is less than the lower limit described above, the cut resistance of the cut resistant glove may be insufficient. On the other hand, when the average thickness of the ground yarn 3 is greater than the upper limit described above, texture of the cut resistant glove composed of stitches of at least 13 gauges, in particular may be deteriorated.

Additional Yarn

The additional yarn 4 is made of an organic fiber, and includes a core yarn 41, and a cover yarn 42 wound around the core yarn 41.

The core yarn 41 made of an organic fiber is not particularly limited as long as it is a yarn having stretchability, and for example, a polyurethane elastic yarn, a woolly processed nylon yarn, a polyester yarn, or the like may be used. Among these, the core yarn 41 of the additional yarn 4 is preferably a polyurethane elastic yarn. When the core yarn 41 of the additional yarn 4 is thus a polyurethane elastic yarn, the fit of the cut resistant glove is improved, and by controlling the thickness of the polyurethane elastic yarn, the contraction of the ground yarn 3 can be suitably prevented, whereby the effect of preventing the ground yarn 3 from being brought into contact with the hand through exposure out from the stitches is enhanced. In addition, owing to an adequate elasticity of the polyurethane elastic yarn, the cover yarn 42 of the additional yarn 4 acquires bulkiness, leading to an improvement of retention of a coagulating agent, etc., of the cover yarn 42 in providing the coating layer. Thus, permeation of the resin or rubber of the coating layer 2 to the inner surface side of the cut resistant glove can be prevented. In addition, at a part where the cover yarn 42 is in contact with the coating layer 2, the coating layer 2 is likely to be impregnated into the bulky cover yarn 42, leading to an improvement of the adhesiveness between the cover yarn 42 and the coating layer 2, whereas the sweat absorbency of the cut resistant glove can be improved.

The lower limit of the average thickness of the core yarn 41 in the case where the additional yarn 4 includes the core yarn 41 and the cover yarn 42 is preferably 10 dtex, more preferably 20 dtex, and still more preferably 25 dtex. Whereas, the upper limit of the average thickness of the core yarn 41 is preferably 44 dtex, and more preferably 35 dtex. When the average thickness of the core yarn 41 is less than the lower limit described above, the fit of the glove may be deteriorated. On the other hand, when the average thickness of the core yarn 41 is greater than the upper limit described above, the stretching force of the core yarn 41 becomes so great that exposure of the ground yarn 3, and the sticking out of the string 31*a* may be caused.

The cover yarn 42 of the additional yarn 4 is composed of a first cover yarn 42*a*, and a second cover yarn 42*b* wound around the surface of the first cover yarn 42*a*. The second cover yarn 42*b* is wound in a direction opposite to a direction of winding of the first cover yarn 42*a*. When the cover yarn 42 of the additional yarn 4 thus has a two-layer structure including the first cover yarn 42*a* and the second cover yarn 42*b*, the retention of a coagulating agent, etc., of the cover yarn 42 is improved, whereby permeation of the resin or rubber of the coating layer 2 to the inner surface side of the cut resistant glove can be prevented. Moreover, as a result of the direction of winding of the first cover yarn 42*a* around the additional yarn 4 opposite to the direction of winding of the second cover yarn 42*b* of the additional yarn 4, the twisting can be cancelled, and thus the distortion of the cut resistant glove can be prevented.

The cover yarn 42 of the additional yarn 4 is not particularly limited, and is exemplified by filament yarns constituted with a woolly polyester, woolly nylon, etc., as the fiber, as well as well-known yarns such as spun yarns constituted with cotton, a polyester, etc., as the fiber. Of these, the cover yarn 42 of the additional yarn 4 is preferably a nylon yarn. When the cover yarn 42 of the additional yarn 4 is a nylon yarn, adhesive strength with the coating layer 2 can be improved, and the flexibility of the cut resistant glove can be increased.

It is to be noted that when a high level cut resistance as a performance of the glove is required, highly strong polyethylene fibers, aramid fibers such as polyparaphenylene terephthalamide, PBC fibers, liquid crystal polymer fibers, or the like can be used for the cover yarn 42.

Also, each cover yarn 42 of the additional yarn 4 (the first cover yarn 42*a* and the second cover yarn 42*b*) is preferably a two-ply yarn formed by stranding two or more and four or less yarns, in light of the strength and elasticity.

The lower limit of the average thickness of each cover yarn 42 of the additional yarn 4 (average thickness of each of the first cover yarn 42*a* and the second cover yarn 42*b*) is preferably 80 dtex, and more preferably 100 dtex. Whereas, the upper limit of the average thickness of each cover yarn 42 of the additional yarn 4 is preferably 320 dtex, and more preferably 160 dtex. When the average thickness of each cover yarn 42 of the additional yarn 4 is less than the lower limit described above, the texture of the glove may be deteriorated. On the other hand, when the average thickness of each cover yarn 42 of the additional yarn 4 is no less than the upper limit described above, the glove is likely to be so thick that the workability may be deteriorated.

The lower limit of the number of winding per meter of the cover yarn 42 of the additional yarn 4 (number of winding of each of the first cover yarn 42*a* and the second cover yarn 42*b*) is preferably 100 times, and more preferably 150 times. Whereas, the upper limit of the number of winding per meter of the cover yarn 42 of the additional yarn 4 is preferably 400 times, and more preferably 300 times. When the number of winding per meter of the cover yarn 42 of the additional yarn 4 is less than the lower limit described above, the effect of preventing the permeation of the resin or rubber of the coating layer 2 to the inner surface side of the cut resistant glove may be insufficient. On the other hand, when the number of winding per meter of the cover yarn 42 of the additional yarn 4 is greater than the upper limit described above, twisting of the additional yarn 4 is likely to occur, and defects may be likely to occur in knitting processing of the cut resistant glove.

In winding the cover yarn 42 around the core yarn 41, draft setting is preferably carried out in which the cover yarn 42 is wound while the core yarn 41 is elongated. The lower limit of the draft setting value is preferably 1.5, and more preferably 2. Whereas, the upper limit of the draft setting value is preferably 3.5, and more preferably 3. When the draft setting value is less than the lower limit described above, stretchability of the additional yarn 4 is insufficient, whereby the fit of the glove may be deteriorated. On the other hand, when the draft setting value is greater than the upper limit described above, contractility of the additional yarn 4 becomes too great, and thus bent string 31*a* sticks out from the surface of the ground yarn 3 to the external side, and may bring about sense of discomfort to the glove wearer. It is to be noted that the "draft setting value is N" as referred to means a setting in which the cover yarn 42 is wound while the core yarn 41 is elongated N times.

The lower limit of the average thickness of the additional yarn 4 is preferably 135 dtex, and more preferably 150 dtex. Whereas, the upper limit of the average thickness of the additional yarn 4 is preferably 670 dtex, more preferably 620 dtex, still more preferably 500 dtex, and particularly preferably 350 dtex. When the average thickness of the additional yarn 4 is less than the lower limit described above, the fit of the glove as well as the feel on touch may be deteriorated. On the other hand, when the average thickness of the additional yarn 4 is greater than the upper limit described above, the glove becomes so thick that the workability may be deteriorated.

The lower limit of the ratio of the average thickness of the additional yarn 4 to the average thickness of the ground yarn 3 is 0.9, and more preferably 1. Whereas, the upper limit of the ratio of the average thickness of the additional yarn 4 to the average thickness of the ground yarn 3 is 2.5, and more preferably 2. When the ratio of the average thickness of the additional yarn 4 to the average thickness of the ground yarn 3 is less than the lower limit described above, the additional yarn 4 fails to sufficiently prevent the ground yarn 3 from being brought into contact with the hand through exposure out from the stitches, whereby the texture and/or the fit of the cut resistant glove may be insufficient. On the other hand, when the ratio of the average thickness of the additional yarn 4 to the average thickness of the ground yarn 3 is greater than the upper limit described above, the thickness of the glove increases, whereby the workability may be deteriorated.

The upper limit of the elongation rate of the elongation of the additional yarn 4 when stretched with applying a load of 30 g, to the length of the additional yarn 4 when stretched with applying a load of 1 g (hereinafter, may be also referred to as "elongation rate of 30-g load to 1-g load") is preferably 150%, and more preferably 100%. When the elongation rate of 30-g load to 1-g load is greater than the upper limit described above, tightening in the glove may be too strong, or sticking out of the string 31*a* may be caused.

The upper limit of the elongation rate of the elongation of the additional yarn 4 when stretched with applying a load of 30 g, to the length of the additional yarn 4 when stretched with applying a load of 3 g (hereinafter, may be also referred to as "elongation rate of 30-g load to 3-g load") is preferably 30%, more preferably 20%, and still more preferably 15%. When the elongation rate of 30-g load to 3-g load is greater than the upper limit described above, tightening in the glove may be too strong, or sticking out of the string 31*a* may be caused.

The lower limit of the elongation rate of the elongation of the additional yarn 4 when stretched with applying a load of 3 g, to the length of the additional yarn 4 when stretched with applying a load of 1 g (hereinafter, may be also referred to as "elongation rate of 3-g load to 1-g load") is preferably 2%, and more preferably 10)%. When the elongation rate of 3-g load to 1-g load is less than the lower limit described above, the fit of the glove may be too loose.

Figure 5:
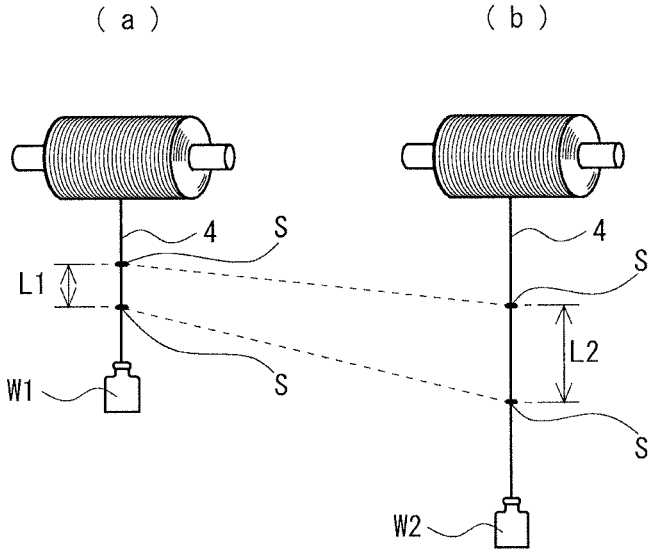
FIG. 5 shows a schematic view illustrating a method for measuring the elongation rate of the additional yarn.

It is to be noted that the elongation rate is calculated based on a bench mark interval determined according to the following procedure. First, as shown in FIG. 5 (*a*), a weight W1 is suspended at the end of the additional yarn 4 to apply a load w1, and a pair of bench marks S are made with a certain interval L1. Next, as shown in FIG. 5 (*b*), a weight W2 that differs from the weight W1 is suspended to apply a load w2, and the interval L2 between the bench marks S is measured. The elongation rate by the load w2 with respect to the load w1 can be calculated from the bench mark intervals L1 and L2 attained when each weight was suspended, according to the following formula:

$$\text{Elongation rate } (L2-L1)/L1\times 100$$

Glove Main Body

The lower limit of the average thickness of the glove main body 1 is preferably 0.1 mm, and more preferably 0.2 mm. In addition, the upper limit of the average thickness of the glove main body 1 is preferably 1.2 mm, more preferably 1 mm, and still more preferably 0.8 mm. When the average thickness of the glove main body 1 is less than the lower limit described above, the strength of the glove itself is unsatisfactory, and thus the durability may be deteriorated. On the other hand, when the average thickness of the glove main body 1 is greater than the upper limit described above, the flexibility of the cut resistant glove is impaired, whereby the workability in use may be deteriorated. It is to be noted that the average thickness of the glove main body 1 is an average of values obtained by measuring at arbitrary five points in a region not covered by the coating layer 2 using a constant, pressure thickness gauge according to JIS L 1086/L 1096 (for example, TECLOCK Corporation "PG-15").

The lower limit of the gauge number for forming stitches of the glove main body 1 is preferably 11 gauges, and more preferably 13 gauges. Whereas, the upper limit of the gauge number is preferably 18 gauges, and more preferably 15 gauges. When the gauge number is less than the lower limit described above, the cut resistant glove becomes hard, and thus the workability in use of the glove may be deteriorated. On the other hand, when the gauge number is greater than the upper limit described above, exposure of the ground yarn 3, as well as deficient covering of the string 31*a* resulting from thinning of the yarn which can be used as the ground yarn 3 may allow sticking out of the string 31*a* to be caused.

Coating Layer

The coating layer 2 imparts an anti-slipping effect to the cut resistant glove. In addition, the coating layer 2 imparts also a waterproof effect and strength to the cut resistant glove. The resin or rubber used in the coating layer 2 is not particularly limited, and a well-known resin or rubber may be used. Examples of the resin include polyvinyl chloride, polyurethane, polyvinylidene chloride, silicone, polyvinyl alcohol, chlorinated polyethylene, ethylene-vinyl alcohol copolymers, and mixtures thereof, and the like. Of these, polyvinyl chloride or polyurethane is preferably used. In addition, examples of the rubber include natural rubbers, isoprene rubbers, acryl rubbers, chloroprene rubbers, butyl rubbers, acrylonitrile butadiene rubbers, fluorine rubbers, styrene-butadiene copolymers, chlorosulfonated polyethylene, epichlorohydrin rubbers, urethane rubbers, ethylene-propylene rubbers and mixtures thereof, and the like. Of these, polyvinyl chloride, a diene type rubber such as a natural rubber, an isoprene rubber, a chloroprene rubber, or an acrylonitrile-butadiene copolymer is preferably used, and a natural rubber and an acrylonitrile-butadiene rubber are particularly preferred in view point of economic aspects, processabilities, elasticity, durability, weather resistance, and the like.

Furthermore, as an additive for the coating layer 2, for example, a crosslinking agent, a vulcanization accelerator, an anti-aging agent, a pigment, a thickening agent, a plasticizer, etc., may be used ad libitum. These may be used either alone, or as a combination of two or more thereof as needed. In addition, in an attempt to attain breathability and grip, the coating layer 2 may be provided as a foaming coating layer through adding a whipping agent, a foam stabilizer, foaming agent and the like.

Manufacturing Method

Next, a method for manufacturing a cut resistant glove using a knitting machine is explained. The method for manufacturing a cut resistant glove predominantly includes the steps of: plating knitting using a ground yarn and an additional yarn (plating knitting step); reversing the inner surface with the outer surface of the knitted glove main body (reversing step); and providing a coating layer on the outer surface of the glove main body (coating layer-providing step).

Plating Knitting Step

In the plating knitting step, plating knitting of the glove main body 1 is conducted using the ground yarn 3 and the additional yarn 4. The plating knitting is a procedure of knitting a plurality of yarns while drawing the same such that the plurality of yarns are separately arranged on the outer surface side and the inner surface side.

In the plating knitting, the ground yarn 3 and the additional yarn 4 are arranged such that the ground yarn 3 is placed on the inner surface side (outer surface side of the glove after the reversing step described later) in the state after the completion of the knitting. Since the ratio of the average thickness of the additional yarn 4 to the average thickness of the ground yarn 3 falls within a certain range according to the method for manufacturing a cut resistant glove, exchanging of the ground yarn 3 and the additional yarn 4 is less likely to occur during the knitting, and thus the ground yarn 3 can be easily arranged so as to be placed on the inner surface side according to the state after the completion of the knitting.

The lower limit of the number of the additional yarn per the ground yarn is preferably one. Whereas, the upper limit of the number of the additional yarn per the ground yarn is preferably five, and more preferably three. When the number of the additional yarn per the ground yarn is greater than the upper limit described above, plating knitting may be difficult.

Reversing Step

In the reversing step, the inner surface and the outer surface of the glove main body 1 knitted as described above are reversed. When the glove main body 1 knitted is used as is, for example, deterioration of the texture due to the sticking out of the yarn in the between-finger part, and coating defects in the coating layer-providing step described later may be caused. In addition, when the knitting is completed, the shape of the fingertip is angular and the fit may be deteriorated. By reversing the inner surface and the outer surface of the knitted glove main body 1 in the reversing step, sticking out of the yarn in the between-finger part is absent, and the fingertip has roundness, leading to an improvement of the texture and/or the fit of the cut resistant glove, and the defects of the coating in the coating layer-providing step can be decreased.

The ground yarn 3 and the additional yarn 4 are arranged such that the ground yarn 3 is placed on the inner surface side in the state after the completion of the knitting in the plating knitting step; therefore, in the glove main body 1 after the reversing step, the ground yarn 3 is arranged on the outer surface side, whereas the additional yarn 4 is arranged on the inner surface side. According to such an arrangement, the cut resistance of the cut resistant glove is secured, and the additional yarn 4 can easily and certainly prevent the ground yarn 3 from being brought into contact with the hand through exposure out from the stitches. Also, since the side of soft additional yarn 4 is brought into contact with the hand, the texture of the cut resistant glove is improved.

Coating Layer-Providing Step

In the coating layer-providing step, the coating layer 2 is provided on the outer surface of the glove main body 1. First, the glove main body 1 is covered on a three-dimensional hand glove mold for immersion, and the palm and/or a part of the fingertips, or the whole of the glove main body is immersed in a coagulating agent. Examples of the coagulating agent include metal salts such as sodium chloride, calcium chloride and calcium nitrate, organic acids such as acetic acid and citric acid. These may be used alone, or two or more types thereof may be used in combination. Of these, calcium nitrate is preferred since the coagulating effect can be exhibited in a shorter period of time. In addition, examples of the solvent of the coagulating agent include methanol, water, and the like. Thus, after the coagulating agent is satisfactorily added dropwise, the palm region and/or a part of the fingertips, or the whole of the glove main body 1 is immersed in the rubber composition or resin composition to form the coating layer 2. By employing this method in which the coagulating agent is used, the coating layer 2 becomes less likely to penetrate into the innermost surface of the glove main body 1, whereby the feel on touch of the inner surface of the glove can be improved. Thereafter, the hand glove mold covered by the glove main body 1 is heated at, for example, a temperature of no less than 60° C. and no greater than 140° C. for a time period of no less than 10 min and no greater than for 120 min, thereby completely vulcanizing (crosslinking or hardening) the coating layer 2. Accordingly, the coating layer 2 can be provided.

Advantages

Owing to the ratio of the average thickness of the additional yarn 4 to the average thickness of the ground yarn 3 falling within the range of no less than 0.9 and no greater than 2.5, the ground yarn 3 can be prevented from being brought into contact with the hand through exposure out from the stitches by the additional yarn 4 in the cut resistant glove. Moreover, according to the cut resistant glove, the texture and/or the fit of the glove can be readily secured by providing a thinner support yarn 31*b* and/or cover yarn 32 of the ground yarn 3, in a case where the cut resistant glove composed of smaller stitches of at least 13 gauges is to be knitted. In addition, owing to the ratio of the ratio of the average thickness of the additional yarn 4 to the average thickness of the ground yarn 3 falling within the above range, influences from the ground yarn 3 on the glove can be reduced, whereby necessary flexibility for the cut resistant glove composed of smaller stitches of at least 13 gauges is likely to be secured. Thus, the cut resistant glove is superior in texture irrespective of the gauge number.

In addition, according to the method for manufacturing a cut resistant glove, since the plating knitting is conducted, and the ratio of the average thickness of the additional yarn 4 to the average thickness of the ground yarn 3 falls within the above range, the additional yarn 4 prevents the ground 3 yarn from being brought into contact with the hand through exposure out from the stitches; therefore, the cut resistant glove that is superior in the texture and/or the fit of the glove can be manufactured. In addition, since the ratio of the average thickness of the additional yarn 4 to the average thickness of the ground yarn 3 falls within the above range, the flexibility of the cut resistant glove is likely to be ensured, and the cut resistant glove that is superior in the texture can be manufactured irrespective of the gauge number.

Other Embodiments

The present invention is not limited to the foregoing embodiments, and in addition to those embodiments the present invention can be practiced according to variously modified or improved embodiments. In the embodiments described above, the support yarn constituting the core material of the ground yarn is wound around the string made of a metal or glass fiber; however, the support yarn may be arranged in parallel with the string without winding around the string.

Furthermore, in the embodiments described above, there involves two cover yarns of the ground yarn, and the winding directions are opposite; however, the winding directions may be the same. In addition, the number of the cover yarn may be one, or three or more. It is to be noted that when only one cover yarn is used, a cover yarn having an average thickness two times the average thickness of the cover yarn of the ground yarn referred to in connection with the above embodiments may be used. Also, when three or more cover yarns are used, the average thickness of the cover yarn is not particularly limited as long as the ratio of the average thickness of the additional yarn to the average thickness of the ground yarn falls within a certain range, and for example, a cover yarn having an average thickness similar to that of the cover yarn of the ground yarn exemplified in the above embodiments may be used. The same applies to the direction and the number of winding of the cover yarn of the additional yarn.

In the embodiments described above, the support yarn is included as the core material of the ground yarn; however, the support yarn is not an essential constitutive component, but in the case where cutting of the string is scarcely concerned, the core material of the ground yarn may be composed of only the string made of a metal or glass fiber. As compared with the case in which the ground yarn has the support yarn, the thickness of the additional yarn can be increased, whereby the flexibility of the knitted glove is improved.

In the embodiments described above, the core yarn and the cover yarn are involved as the additional yarn; however, the cover yarn is not an essential constitutive component, but an additional yarn may be composed of only the core yarn. When the additional yarn is composed of only the core yarn, the thickness of the core yarn may be equivalent to the thickness of the additional yarn in the embodiments described above.

Furthermore, in the embodiments described above, the ground yarn is arranged on the outer surface side of the glove main body; however, the arrangement of the ground yarn on the outer surface side of the glove main body is not an essential constitutive feature, but for example, the ground yarn may be arranged so as to be interposed among a plurality of additional yarns. In addition, embodiments in which the ground yarn is arranged on the inner surface side of the glove, whereas the additional yarn is arranged on the outer surface side of the glove are also involved in the scope contemplated by the present invention. When a bulky yarn or a fluffy spun yarn is used as the additional yarn, the additional yarn is likely to be in contact with the hand over the ground yarn, whereby an improvement of the feel on touch of the glove is enabled although the extent of the improvement may be somewhat inferior to that in the aforementioned embodiments.

In the embodiments described above, the coating layer is provided on the palm region, the side region thereof, and the fingertip region; however, the region on which the coating layer is provided is not limited thereto. For example, full coating in which the coating is executed over the wrist on both the palm and back of the hand, or knuckle coating in which the coating is executed on a region excluding the back of the hand may be also carried out. In addition, the coating layer to be provided is one layer in the embodiments described above; however, multilayer coating of two or more layers is also acceptable. To the contrary, the cut resistant glove may not have a coating layer.

EXAMPLES

Hereinafter, the present invention will be explained in more detail by way of Examples and Comparative Examples, but the invention is not limited to the following Examples.

Example 1

Production of Ground Yarn

A straight polyester filament yarn (number of the filament: 24; 78 dtex) not subjected to a false twisting processing was gently wound around one stainless wire (manufactured by Nippon Seisen Co., Ltd.) having a diameter of 30 μm, at a number of winding of 30 times/meter (TPM) so as to lie along the stainless wire, and thereon by using two polyester textured yarns (number of the filament: 36; 83 dtex), winding by S twisting and Z twisting at a number of winding of 700 times/m was each executed to produce a ground yarn.

Production of Additional Yarn

While taking-up one Spandex of 22 dtex with three-times elongation (draft setting value: 3) , winding of two woolly nylon yarns (number of the filament: 24; 156 dtex in total with two-ply yarn of 78-dtex yarns; by S twisting and Z twisting at a number of winding of 200 times/m was each executed to produce an additional yarn.

Knitting of Glove

The ground yarn and the additional yarn were subjected to plating knitting using a 13-gauges knitting machine (Shima Seiki Mfg., Ltd., "N-SFG-13G") to knit a grove composed of stitches of 13 gauges, and the knitted glove was reversed. It is to be noted that according to the arrangement of the yarns of the plating knitting, the ground yarn was situated on the outer surface side when the knitted glove was reversed.

Formation of Coating Layer

As a coating layer material, a nitrile butadiene rubber latex compound material having a solid content of 40% was prepared. To the compound were blended 1.0 part by mass of colloid sulfur, 1.0 part by mass of zinc oxide, 0.2 parts by mass of zinc dibutyldithiocarbamate and 0.3 parts by mass of polyacrylic acid based thickening agent, with respect to 100 parts by mass of the solid content of NBR latex ("NIPOL LX550" available from ZEON Corporation), and the solid content was adjusted by diluting with water. The coating layer material had a viscosity of 1,000 mPa·s. Also, as the coagulating agent liquid, a methanol solution containing 1% by mass calcium nitrate was prepared.

The glove was placed on a ceramic hand glove mold, and heated at 70° C. Thereafter, the coagulating agent liquid was applied by an immersion processing. Thereafter, the excess coagulating agent was removed, and the coating layer material was applied by an immersion processing. The glove after the application was heated at a temperature of 80° C. for 30 min, and then heated at a temperature of 130° C. for 30 min to form a coating layer. Subsequently, the glove was released from the hand glove mold, and washed with water and dried to obtain a cut resistant glove.

Examples 2 to 8, and Comparative Example 1

Cut resistant gloves were obtained in a similar manner to Example 1 except that the ground yarn and the additional yarn in Example 1 were changed as shown in Table 1.

Example 9

A cut resistant glove was obtained in a similar manner to Example 1 except that the knitted glove was not reversed in the knitting of the glove of Example 1. It is to be noted that regarding the arrangement of the yarns, the additional yarn is placed on the outer surface side.

Comparative Example 2

A cut resistant glove was obtained in a similar manner to Example 1 except that the ground yarn and the additional yarn in Example 1 were changed as shown in Table 1, and a 10-gauges knitting machine ("N-SFG-10G" available from Shima Seiki Mfg., Ltd.) was used to knit a glove composed of stitches of 10 gauges.

TABLE 1

| | Ground yarn | | | | | | | Additional yarn | | | | |
|---|---|---|---|---|---|---|---|---|---|---|---|---|
| | | support yarn | | cover yarn | | | | | cover yarn | | | |
| | core yarn material | material | number of winding (TPM) | material | number of winding (TPM) | number of covering | thick-ness (dtex) | core yarn material | material | number of winding (TPM) | number of covering | thick-ness (dtex) |
| Example 1 | ϕ30 μm SUS304 | 78 dtex/24 f polyester | 30 | 83 dtex/ 36 f polyester textured | 700 | 2 | 316 | 22 dtex Spandex | total 156 dtex 78 dtex/24 f woolly nylon two-ply yarn | 200 | 2 | 340 |
| Example 2 | ϕ30 μm SUS304 | 114 dtex/24 f polyester | 30 | 83 dtex/ 36 f polyester textured | 700 | 2 | 352 | 22 dtex Spandex | total 156 dtex 78 dtex/24 f woolly nylon two-ply yarn | 200 | 2 | 340 |
| Example 3 | ϕ30 μm SUS304 | 78 dtex/24 f polyester | 30 | 83 dtex/ 36 f polyester textured | 700 | 2 | 316 | 22 dtex Spandex | total 311 dtex 78 dtex/24 f woolly nylon two-ply yarn × 2 | 200 | 2 | 669 |

TABLE 1-continued

| | Ground yarn | | | | | | | Additional yarn | | | | |
|---|---|---|---|---|---|---|---|---|---|---|---|---|
| | | support yarn | | cover yarn | | | | | cover yarn | | | |
| | core yarn material | material | number of winding (TPM) | material | number of winding (TPM) | number of covering | thick-ness (dtex) | core yarn material | material | number of winding (TPM) | number of covering | thick-ness (dtex) |
| Example 4 | ϕ30 μm SUS304 | 78 dtex/24 f polyester | 30 | 83 dtex/ 36 f polyester textured | 700 | 2 | 316 | 44 dtex Spandex | total 156 dtex 78 dtex/24 f woolly nylon two-ply yarn | 200 | 2 | 352 |
| Example 5 | ϕ30 μm SUS304 | 78 dtex/24 f polyester | 30 | 83 dtex/ 36 f polyester textured | 700 | 2 | 316 | 78 dtex Spandex | total 156 dtex 78 dtex/24 f woolly nylon two-ply yarn | 200 | 2 | 361 |
| Example 6 | ϕ30 μm SUS304 | 78 dtex/24 f polyester | 30 | 83 dtex/ 36 f polyester textured | 700 | 2 | 316 | 140 dtex Spandex | total 156 dtex 78 dtex/24 f woolly nylon two-ply yarn | 200 | 2 | 387 |
| Example 7 | ϕ30 μm SUS304 | 78 dtex/24 f polyester | 30 | 83 dtex/ 36 f polyester textured | 700 | 2 | 316 | total 311 dtex 78 dtex/24 f woolly nylon two-ply yarn × 2 | — | — | — | 311 |
| Example 8 | ϕ30 μm SUS304 | 78 dtex/24 f polyester | 30 | 83 dtex/ 36 f polyester textured | 700 | 2 | 316 | total 294 dtex #30 cotton yarn × 2 | — | — | — | 294 |
| Example 9 | ϕ30 μm SUS304 | 78 dtex/24 f polyester | 30 | 83 dtex/ 36 f polyester textured | 700 | 2 | 316 | 22 dtex Spandex | total 156 dtex 78 dtex/24 f woolly nylon two-ply yarn | 200 | 2 | 340 |
| Com-parative Example 1 | ϕ30 μm SUS304 | 78 dtex/24 f polyester | 30 | 83 dtex/ 36 f polyester textured | 700 | 2 | 316 | 22 dtex Spandex | total 78 dtex 78 dtex/24 f single yarn | 200 | 2 | 179 |
| Com-parative Example 2 | ϕ30 μm SUS304 | 78 dtex/24 f polyester | 30 | 83 dtex/ 36 f polyester textured | 700 | 2 | 316 | 22 dtex Spandex | total 416 dtex 78 dtex/24 f woolly nylon two-ply yarn × 2 + single yarn | 200 | 2 | 835 |

Evaluations

The elongation rate of the additional yarn, the uncomfortable feeling, the flexibility and the fit were evaluated on Examples 1 to 9, and Comparative Examples 1 and 2. These results are shown in Table 2.

Elongation Rate of Additional Yarn

The elongation rate of the additional yarn was calculated based on the bench mark interval measured according to the following procedure. First, as shown in FIG. 5, a weight of 1 g is suspended at the end of the additional yarn 4, and bench marks are made with a 10-cm interval. Next, a weight of 3 g and a weight of 30 g are each suspended, and each interval of the bench marks is measured. The elongation rate is determined from the bench mark intervals attained when each weight was suspended. For example, the elongation rate of 30-g load to 1-g load can be calculated as:

Elongation rate of 30-g load to 1-g load={(bench mark interval with 30-g load)−(bench mark interval with 1-g load)}/(bench mark interval with 1-g load)×100.

Uncomfortable Feeling

Each ten gloves were worn by ten panels and the uncomfortable feeling resulting from prick pain, sticking out of the string, etc., was evaluated according to the following five criteria, and an average of the results of the evaluations was determined. The evaluation more approximate to A indicates superior texture of the glove.

Criteria of Evaluation of Uncomfortable Feeling

A: uncomfortable feeling was sensed from none of the gloves;

B: uncomfortable feeling was sensed from one to two of the gloves, but any one was not very uncomfortable; of the gloves, but any one was not very uncomfortable;

D: uncomfortable feeling was sensed from five to six of the gloves, but any one was not very uncomfortable; and E: uncomfortable feeling was sensed from seven or more of the gloves, or at least one was very uncomfortable.

Flexibility

The gloves were worn by ten panels and the flexibility was evaluated according to the following five criteria, and an average of the results of the evaluations was determined. The evaluation more approximate to A indicates superior texture of the glove.

Criteria of Evaluation of Flexibility

A: flexibility being very high;

B: flexibility being high;

C: flexibility being found;

D: flexibility being low; and

E: flexibility being very low.

Fit

The gloves were worn by ten panels and the fit was evaluated according to the following five criteria, and an average of the results of the evaluations was determined.

Criteria of Evaluation of Fit

A: fit being very superior;

B: fit being superior;

C: fit being found;

D: somewhat strong tightening feeling or a somewhat loose tightening feeling was sensed, and fit being inferior; and E: too strong tightening feeling or too loose tightening feeling was sensed, fit being very inferior.

TABLE 2

| | Glove knitting | | Ratio of thickness of additional yarn to ground yarn | Elongation rate of additional yarn (%) | | | Results of evaluation | | |
|---|---|---|---|---|---|---|---|---|---|
| | gauge number | reverse | | 30-g/1-g | 30-g/3-g | 3-g/1-g | uncomfortable feeling | flexibility | fit |
| Example 1 | 13 | done | 1.08 | 63 | 11 | 47 | A | A | A |
| Example 2 | 13 | done | 0.97 | 63 | 11 | 47 | A | B | A |
| Example 3 | 13 | done | 2.12 | 64 | 11 | 49 | A | C | B |
| Example 4 | 13 | done | 1.11 | 73 | 19 | 45 | A | A | B |
| Example 5 | 13 | done | 1.14 | 127 | 57 | 45 | C | A | C |
| Example 6 | 13 | done | 1.22 | 173 | 122 | 23 | D | A | D |
| Example 7 | 13 | done | 0.98 | 15 | 6 | 8 | A | A | A |
| Example 8 | 13 | done | 0.93 | 2 | 2 | 0 | A | A | D |
| Example 9 | 13 | not done | 1.08 | 63 | 11 | 47 | C | A | A |
| Comparative Example 1 | 13 | done | 0.57 | 60 | 11 | 45 | E | A | A |
| Comparative Example 2 | 10 | done | 2.64 | 65 | 11 | 19 | A | E | C |

From the results shown in Table 2, it is revealed that the cut resistant gloves of Examples 1 to 9 did not result in very inferior uncomfortable feeling and flexibility as compared with the cut resistant gloves of Comparative Example 1 and Comparative Example 2. From these, it is proven that when the ratio of the average thickness of the additional yarn to the average thickness of the ground yarn of the cut resistant glove is adjusted to fall within a certain range, the texture and/or the fit of the glove can be superior. To the contrary, since the cut resistant glove of Comparative Example 1 has a low ratio of the average thickness of the additional yarn to the average thickness of the ground yarn, the additional yarn 4 fails to sufficiently prevent the ground yarn 3 from being brought into contact with the hand through exposure out from the stitches, and thus the texture of the cut resistant glove is believed to be insufficient. Also, according to the cut resistant glove of Comparative Example 2, the ratio of the average thickness of the additional yarn to the average thickness of the ground yarn is so high that the increased thickness of the glove leads to lack in flexibility, and the tightening in the glove tends to be so loose that the fit is considered to become inferior.

Comparison of Examples 1 to 3 having varying ratio of the average thickness of the additional yarn to the average thickness of the ground yarn indicates superior flexibility and fit in Example 1. Accordingly, it is revealed that when the ratio of the average thickness of the additional yarn to the average thickness of the ground yarn of the cut resistant glove is no less than 1 and no greater than 2, a further improvement of the texture of the glove is proven to be enabled.

When Examples 1 to 4 were compared with Example 5 and Example 6, Examples 1 to 4 having the elongation rate of 30-g load to l-g load, and the elongation rate of 30-g load to 3-g load of the additional yarn that are each smaller exhibited superior uncomfortable feeling and superior fit. Accordingly, by adjusting the elongation rate of 30-g load to 1-g load and/or the elongation rate of 30-g load to 3-g load of the additional yarn to be no greater than a certain value, it is proven that excessively strong tightening in the glove can be avoided, and uncomfortable feeling resulting from sticking out of the string, etc., is less likely to occur.

On the other hand, when Examples 1 to 4 were compared with Example 8, Examples 1 to 4 having a greater elongation rate of 3-g load to 1-g load of the additional yarn is superior in fit than Example 8 in which the cotton yarn having low stretchability was used for the additional yarn. From this finding, by adjusting the elongation rate of 3-g load to 1-g load of the additional yarn to be no less than a certain value, it is proven that appropriate stretchability is imparted to the glove, and thus the fit is likely to be attained.

In addition, when Example 1 is compared with Example 3, it is revealed that Example 2 in which the ground yarn is arranged on the outer surface side received a better evaluation of the uncomfortable feeling. Accordingly, it is proven that by arranging the ground yarn on the outer surface side, the additional yarn was able to prevent the ground yarn from being brought into contact with the hand through exposure out from the stitches.

Study on Draft Setting in Producing Additional Yarn

A cut resistant glove was obtained in a similar manner to Example 1 except that with regard to the additional yarn of Example 1, in the step of winding the cover yarn on Spandex with two-times elongation, the draft setting value was 2, and the cover yarn was wound. This cut resistant glove exhibited further improved fit. By adjusting the draft setting value to be 2, the cover yarn is fully extended before the returning force of Spandex increases. As a result, it is proven that the returning force of the additional yarn decreases, and thus the sticking out of the ground yarn from the core yarn can be prevented and the excessive tightening feeling can be prevented. In addition, in the case where the draft setting was low, when the thickness of Spandex is great in particular, the excessive tightening is loosen, whereby the fit tended to be improved. To the contrary, when the fit is insufficient, the draft setting value is preferably made high.

Study on Number of Winding of Cover Yarn in Producing Additional Yarn

A cut resistant glove was obtained in a similar manner to Example 1 except that in regard to the additional yarn in Example 1, the number of winding of the cover yarn per unit length was increased to 300 times/m in the step of winding the cover yarn around Spandex. The cut resistant glove exhibited further improved fit. An increase of the number of winding per unit length of the cover yarn permitted the additional yarn to be tightly squeezed, whereby a decrease of the stretchability was enabled. From this result, it is considered that when the additional yarn has excessive stretchability, the stretchability can be controlled by adjusting the number of winding of the cover yarn.

Study on Support Yarn

As shown in Table 3, in a similar manner to Example 2 and Example 4 except that the support yarn was not used in the ground yarns of Example 2 and Example 4, cut resistant gloves of Example 10 and Example 11 were obtained. Evaluations similar to those in Example 1 were made on these cut resistant gloves. The results are shown in Table 4.

TABLE 4

| | Glove knitting | | Ratio thickness of additional yarn to ground yarn | Elongation rate of additional yarn (%) | | | Results of evaluation | | |
|---|---|---|---|---|---|---|---|---|---|
| | gauge number | reverse | | 30-g/1-g | 30-g/3-g | 3-g/1-g | uncomfortable feeling | flexibility | fit |
| Example 10 | 13 | done | 1.43 | 63 | 11 | 47 | C | A | A |
| Example 11 | 13 | done | 1.48 | 73 | 19 | 45 | C | A | B |

TABLE 3

| | Ground yarn | | | | | Additional yarn | | | | |
|---|---|---|---|---|---|---|---|---|---|---|
| | | cover yarn | | | | | cover yarn | | | |
| | core yarn material | material | number of winding (TPM) | number of covering | thickness (dtex) | core yarn material | material | number of winding (TPM) | number of covering | thickness (dtex) |
| Example 10 | ϕ30 μm SUS304 | 83 dtex/36 f polyester textured | 700 | 2 | 238 | 22 dtex Spandex | total 156 dtex 78 dtex/24 f woolly nylon two-ply yarn | 200 | 2 | 340 |
| Example 11 | ϕ30 μm SUS304 | 83 dtex/36 f polyester textured | 700 | 2 | 238 | 44 dtex Spandex | total 156 dtex 78 dtex/24 f woolly nylon two-ply yarn | 200 | 2 | 352 |

The results shown in Table 4 indicate that, as compared with the cut resistant gloves of Example 2 and Example 4, an equivalent or improved evaluation of the flexibility was made on the gloves of Example 10 and Example 11, although the evaluation of the uncomfortable feeling was somewhat inferior. From these results, it is revealed that cut resistant glove not having the support yarn attains improved flexibility.

As described in the foregoing, the cut resistant glove of the present invention has stretchability and is superior in the texture and fit, while a string made of a metal or glass fiber is prevented from sticking out, irrespective of the gauge number.

EXPLANATION OF THE REFERENCE SYMBOLS

1 glove main body
2 coating layer
3 ground yarn
4 additional yarn
31 core material
31*a* string
31*b* support yarn
32 cover yarn
32*a* first cover yarn
32*b* second cover yarn
41 core yarn
42 cover yarn
42*a* first cover yarn
42*b* second cover yarn
W1, W2 weight
S bench mark

The invention claimed is:

1. A cut resistant glove comprising a glove main body manufactured by plating knitting using a ground yarn and an additional yarn, wherein the ground yarn comprises a core material, and a cover yarn wound around the core material, wherein the core material comprising a string made of a metal or glass fiber, wherein the core material further comprising a support yarn made of an organic fiber arranged along the string, wherein an average thickness of the support yarn being no less than 45 dtex and no greater than 100 dtex, and the additional yarn being made of organic fiber and comprising a core yarn and a cover yarn wound around the core yarn of the additional yarn, an elongation rate of 30-g load to 3-g load of the additional yarn is no greater than 30%, an average thickness of the ground yarn is no less than 135 dtex and no greater than 440 dtex, and an average thickness of the additional yarn is no less than 135 dtex and no greater than 670 dtex, and wherein a ratio of the average thickness of the additional yarn to the average thickness of the ground yarn is no less than 0.9 and no greater than 2.5, and the cut resistant glove is composed of stitches of at least 13 gauges and is provided with a coating layer made of a resin or rubber on an outer surface side of the glove.

2. The cut resistant glove according to claim 1, wherein an average thickness of the core yarn of the additional yarn is no less than 10 dtex and no greater than 44 dtex.

3. The cut resistant glove according to claim 1, wherein the core yarn of the additional yarn is a polyurethane elastic yarn, and the cover yarn of the additional yarn is a nylon yarn.

4. The cut resistant glove according to claim 1, wherein the metal is a stainless steel.

5. The cut resistant glove according to claim 1, wherein the ground yarn is arranged on an outer surface side of the glove.

6. The cut resistant glove according to claim 1, wherein an average thickness of the cover yarn of the ground yarn is no less than 45 dtex and no greater than 100 dtex.

7. The cut resistant glove according to claim 1, wherein a number of winding per meter of the cover yarn of the ground yarn is 600 times.

8. A method for manufacturing a cut resistant glove comprising a glove body, the glove body comprising plating knitting using a ground yarn and an additional yarn and then forming a coating layer made of a resin or rubber on an outer surface side of the love body, wherein the ground yarn comprises a core material, and a cover yarn wound around the core material, the core material comprising a string made of a metal or glass fiber, the core material further comprising a support yarn made of organic fiber arranged along the string, an average thickness of the support yarn being no less than 45 dtex and no greater than 100 dtex, and the additional yarn being made of organic fiber and comprising a core yarn and a cover yarn wound around the core yarn of the additional yarn, an elongation rate of 30-g load to 3-g load of the additional yarn is no greater than 30%, an average thickness of the ground yarn is no less than 135 dtex and no greater than 440 dtex, and an average thickness of the additional yarn is no less than 135 dtex and no greater than 670 dtex, and wherein a ratio of the average thickness of the additional yarn to the average thickness of the ground yarn is no less than 0.9 and no greater than 2.5, and the cut resistant glove is composed of stitches of at least 13 gauges.

* * * * *